US012504175B2

(12) United States Patent
Bianchi

(10) Patent No.: US 12,504,175 B2
(45) Date of Patent: Dec. 23, 2025

(54) AIR-TIGHT REMOVABLE DIVIDER AND THERMAL BREAK

(71) Applicant: WHIRLPOOL CORPORATION, Benton Harbor, MI (US)

(72) Inventor: Fabio Bianchi, Ranco (IT)

(73) Assignee: Whirlpool Corporation, Benton Harbor, MI (US)

( * ) Notice: Subject to any disclaimer, the term of this patent is extended or adjusted under 35 U.S.C. 154(b) by 427 days.

(21) Appl. No.: 18/077,332

(22) Filed: Dec. 8, 2022

(65) Prior Publication Data

US 2024/0191881 A1 Jun. 13, 2024

(51) Int. Cl.
*F24C 15/16* (2006.01)
*F24C 15/00* (2006.01)
*F24C 15/34* (2006.01)

(52) U.S. Cl.
CPC ..... *F24C 15/007* (2013.01); *F24C 15/34* (2013.01)

(58) Field of Classification Search
CPC ..... F24C 15/007; F24C 15/16; F24C 15/34; F24C 15/168
See application file for complete search history.

(56) References Cited

U.S. PATENT DOCUMENTS 4,140,888 A 2/1979 Baron et al.
4,780,597 A 10/1988 Linhart et al.
5,796,082 A 8/1998 Kim
5,981,927 A 11/1999 Osepchuk et al.
6,545,251 B2 4/2003 Allera et al.
7,071,448 B1 * 7/2006 Kim ..... F24C 15/16 219/400
7,087,872 B1 8/2006 Dobie et al.
7,129,447 B1 10/2006 Kim et al.
7,183,520 B2 2/2007 Park
(Continued)

FOREIGN PATENT DOCUMENTS

BE 867122 A1 9/1978
DE 3923734 C1 8/1990
(Continued)

OTHER PUBLICATIONS

US 8,420,991 B2, 04/2013, Mihara et al. (withdrawn)

*Primary Examiner* — Gregory A Wilson
(74) *Attorney, Agent, or Firm* — Price Heneveld LLP

(57) ABSTRACT

An oven is provided including a cooking cavity having side walls each including a protruding divider rail extending horizontally along the side wall and a divider rail emboss disposed above the protruding divider rail; and a divider assembly to divide the cooking cavity into cooking subcavities. The divider assembly includes: a panel having a bottom surface, and first and second side edges, the first and second side edges each having a recess; movable closures positioned within the recesses; a plurality of springs positioned within the recesses for biasing the movable closures out from the recesses while allowing the movable closures to slide inward inside the recesses, wherein the movable closures are configured to extend into the respective divider rail embosses when the bottom surface of the panel rests on the protruding divider rails so as to lock the divider assembly in place while increasing airtightness and reducing heat migration.

20 Claims, 13 Drawing Sheets

(56) References Cited

U.S. PATENT DOCUMENTS

| | | | | |
|---|---|---|---|---|
| 8,733,862 | B1 * | 5/2014 | Armstrong | F25D 25/02 126/339 |
| 10,129,936 | B2 | 11/2018 | Carlsson et al. | |
| 10,764,970 | B2 | 9/2020 | Giordano | |
| 11,071,176 | B2 | 7/2021 | Khizar et al. | |
| 11,346,560 | B2 | 5/2022 | Dingman et al. | |
| 2002/0060215 | A1 | 5/2002 | Allera et al. | |
| 2008/0087662 | A1 | 4/2008 | Takizaki et al. | |
| 2010/0176123 | A1 | 7/2010 | Mihara et al. | |
| 2011/0073344 | A1 | 3/2011 | Zhang et al. | |
| 2011/0266463 | A1 | 11/2011 | Einziger et al. | |
| 2013/0153570 | A1 | 6/2013 | Carlsson et al. | |
| 2014/0231421 | A1 * | 8/2014 | Yang | H05B 6/6408 219/763 |
| 2017/0251529 | A2 | 8/2017 | Spagnoli | |

FOREIGN PATENT DOCUMENTS

| | | | | | |
|---|---|---|---|---|---|
| EP | 1672284 | A1 | | 6/2006 | |
| EP | 2789920 | A1 | | 10/2014 | |
| EP | 2630839 | B1 | | 11/2014 | |
| EP | 3339745 | A1 | | 6/2018 | |
| EP | 2966935 | B1 | * | 2/2020 | H05B 6/64 |
| EP | 3851746 | A1 | * | 7/2021 | F24C 15/16 |
| GB | 2002210 | | | 2/1979 | |
| GB | 2169072 | A | * | 7/1986 | F24C 15/16 |
| JP | 85842195 | | | 3/1983 | |
| KR | 20060065949 | A | | 6/2006 | |
| KR | 102207470 | | | 1/2021 | |
| RU | 2127649 | C1 | | 3/1999 | |
| WO | 0182653 | A1 | | 11/2001 | |
| WO | 2009011111 | A1 | | 1/2009 | |
| WO | 2015099648 | A1 | | 7/2015 | |
| WO | 2016034191 | A1 | | 3/2016 | |
| WO | WO-2018024557 | A1 | * | 2/2018 | |

* cited by examiner

AIR-TIGHT REMOVABLE DIVIDER AND THERMAL BREAK

BACKGROUND OF THE DISCLOSURE

The present disclosure generally relates to a divider assembly for dividing an enclosed cooking cavity of an oven into two cooking subcavities, and to an oven including the divider assembly.

SUMMARY OF THE DISCLOSURE

According to one aspect of the present disclosure, an oven is provided including: an enclosed cooking cavity having first and second side walls, the first side wall comprising a first protruding divider rail extending horizontally along the first side wall and a first divider rail emboss disposed above the first protruding divider rail, the second side wall comprising a second protruding divider rail extending horizontally along the second side wall and a second divider rail emboss disposed above the second protruding divider rail; a divider assembly within the enclosed cooking cavity so as to divide the enclosed cooking cavity into a first cooking subcavity and a second cooking subcavity; a first heating source for generating heat within the first cooking subcavity to cook food disposed therein; and a second heating source for generating heat within the second cooking subcavity to cook food disposed therein. The divider assembly includes: a panel having a top surface, a bottom surface, and first and second side edges, the first side edge comprising a first recess and the second side edge comprising a second recess; a first movable closure positioned within the first recess; a first plurality of springs positioned within the first recess for biasing the first movable closure out from the first recess while allowing the first movable closure to slide inward inside the first recess; a second movable closure positioned within the second recess; and a second plurality of springs positioned within the second recess for biasing the second movable closure out from the second recess while allowing the second movable closure to slide inward inside the second recess. The first and second movable closures are configured to extend into the respective first and second divider rail embosses when the bottom surface of the panel rests on the first and second protruding divider rails so as to lock the divider assembly in place while increasing an airtightness and reducing heat migration.

According to another aspect of the present disclosure, a divider assembly is provided for dividing an enclosed cooking cavity of an oven into two cooking subcavities, the oven including a first side wall and a second side wall within the enclosed cooking cavity, the first and second side walls including respective first and second divider rail embosses extending horizontally. The divider assembly including: a panel having a top surface, a bottom surface, and first and second side edges, the first side edge comprising a first recess and the second side edge comprising a second recess; a first movable closure positioned within the first recess; a first plurality of springs positioned within the first recess for biasing the first movable closure out from the first recess while allowing the first movable closure to slide inward inside the first recess; a second movable closure positioned within the second recess; and a second plurality of springs positioned within the second recess for biasing the second movable closure out from the second recess while allowing the second movable closure to slide inward inside the second recess. The first and second movable closures are configured to extend into the respective first and second divider rail embosses so as to lock the divider assembly in place while increasing an airtightness and reducing heat migration.

According to yet another aspect of the present disclosure, a method is provided for dividing an enclosed cooking cavity of an oven into a first cooking subcavity and a second cooking subcavity, where the oven includes first and second side walls each having a respective first and second divider rail emboss extending horizontally. The method comprises: providing a divider assembly within the enclosed cooking cavity so as to divide the enclosed cavity into the first cooking subcavity and the second cooking subcavity, wherein the divider assembly includes: a panel having a top surface, a bottom surface, and first and second side edges, the first side edge comprising a first recess and the second side edge comprising a second recess; a first movable closure positioned within the first recess; a first plurality of springs positioned within the first recess for biasing the first movable closure out from the first recess while allowing the first movable closure to slide inward inside the first recess; a second movable closure positioned within the second recess; and a second plurality of springs positioned within the second recess for biasing the second movable closure out from the second recess while allowing the second movable closure to slide inward inside the second recess. The first and second movable closures are configured to extend into the respective first and second divider rail embosses so as to lock the divider assembly in place while increasing an airtightness and reducing heat migration.

These and other features, advantages, and objects of the present disclosure will be further understood and appreciated by those skilled in the art by reference to the following specification, claims, and appended drawings.

Figure 1:
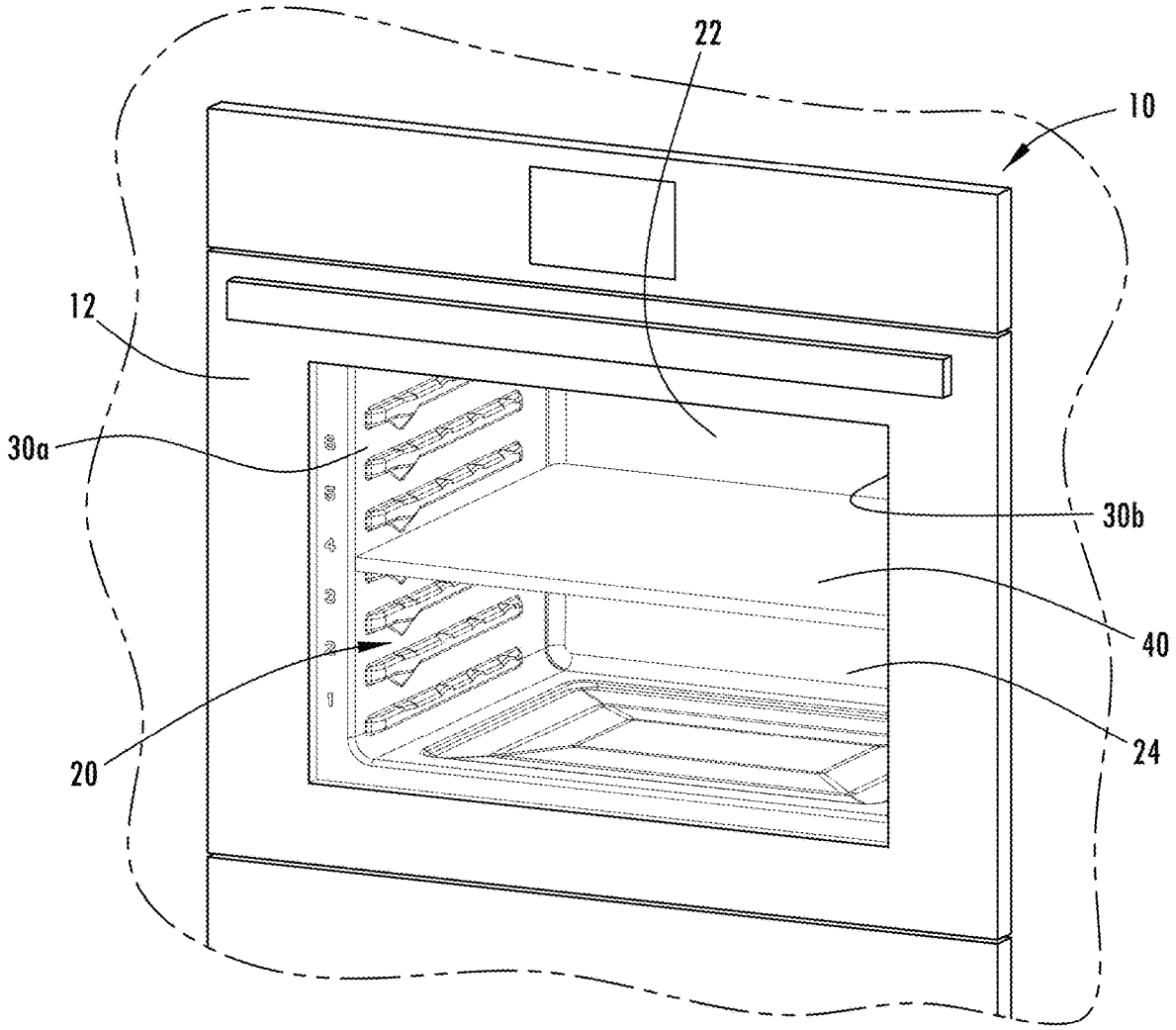
FIG. 1 is a perspective view of an oven according to a first embodiment.
Figure 5:
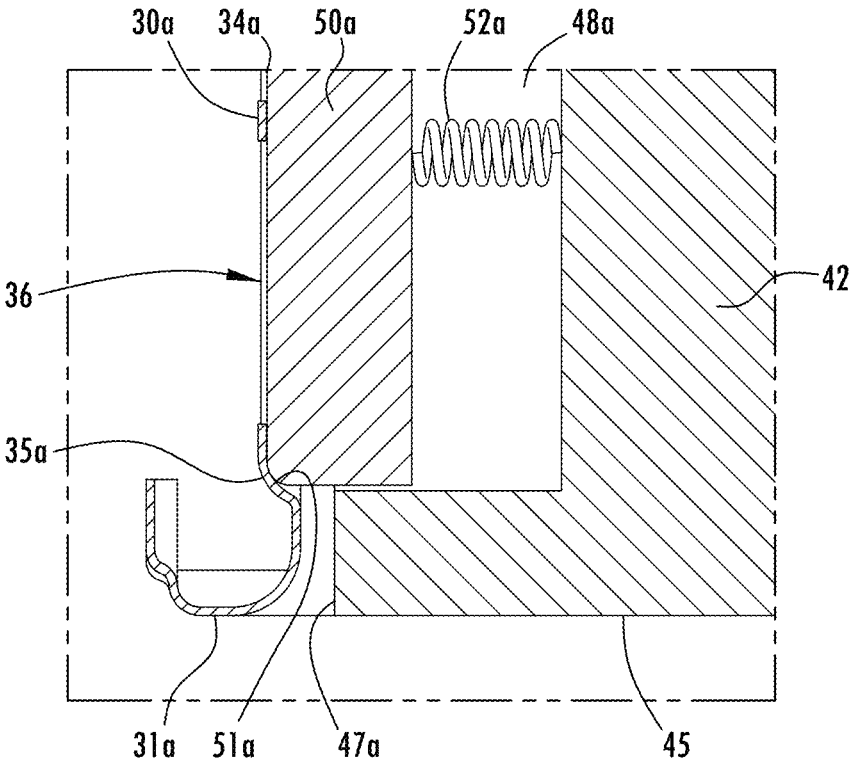
FIG. 5 is an enlarged isometric cross-sectional top view of a portion of the enclosed cooking cavity shown in FIG. 1 with a divider assembly fully installed.
Figure 6:
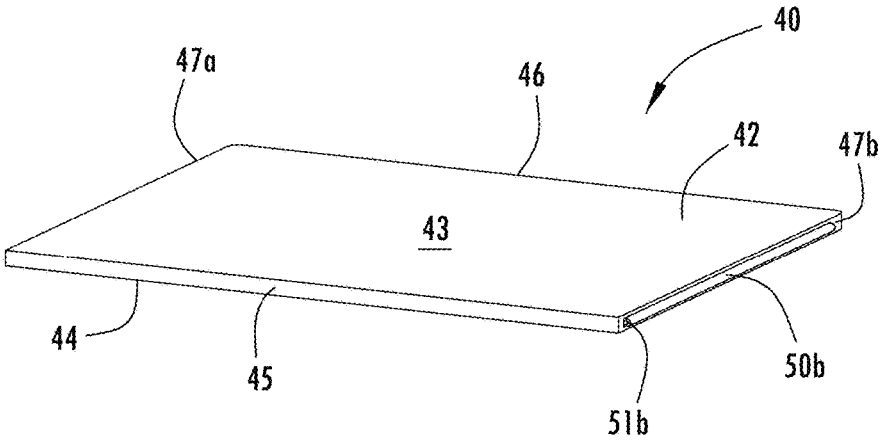
FIG. 6 is a perspective view of the divider assembly used in the oven shown in FIG. 1.
Figure 6A:
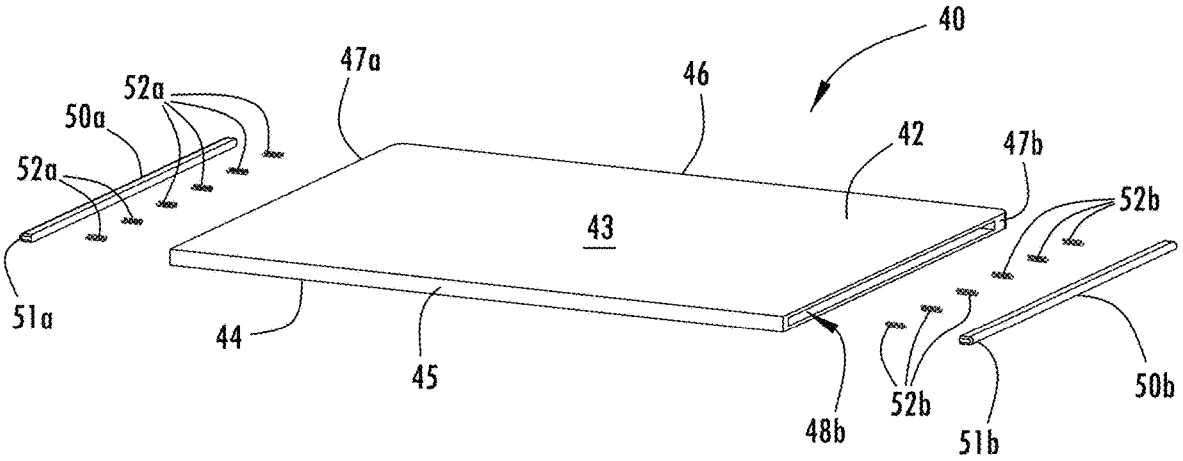
FIG. 6A is an exploded perspective view of the divider assembly shown in FIG. 6.
Figure 7:
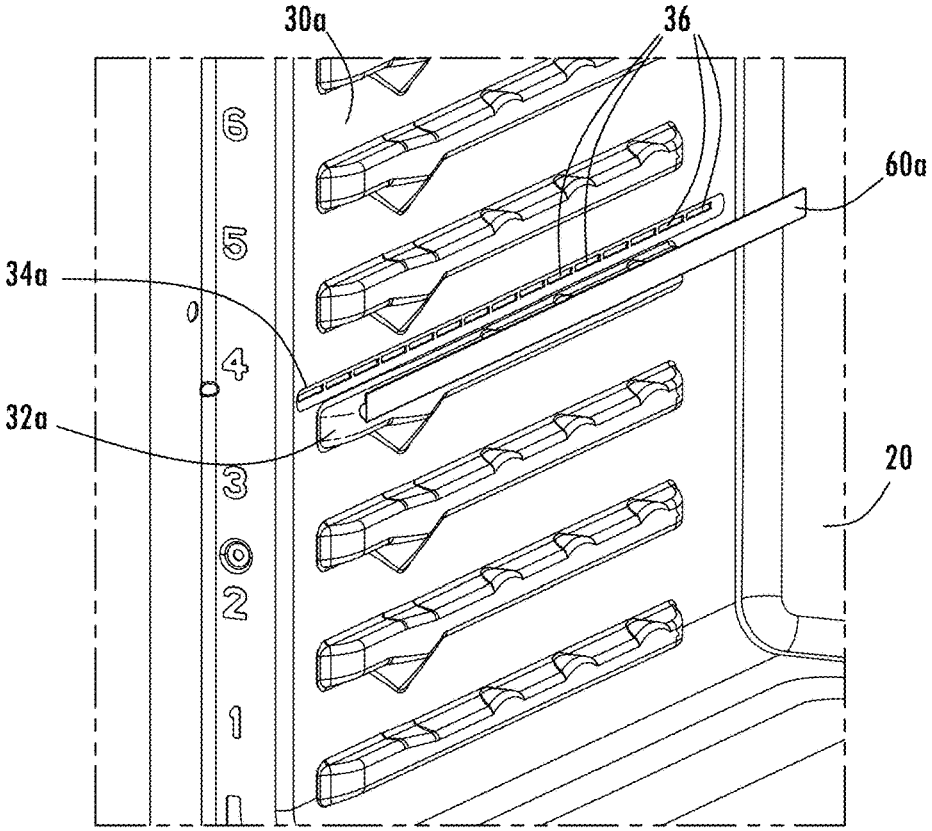
FIG. 7 is an enlarged perspective view of a side wall of the enclosed cavity of the oven shown in FIG. 1 with a magnetic ribbon being inserted into a divider rail emboss when the divider assembly is removed.
Figure 7A:
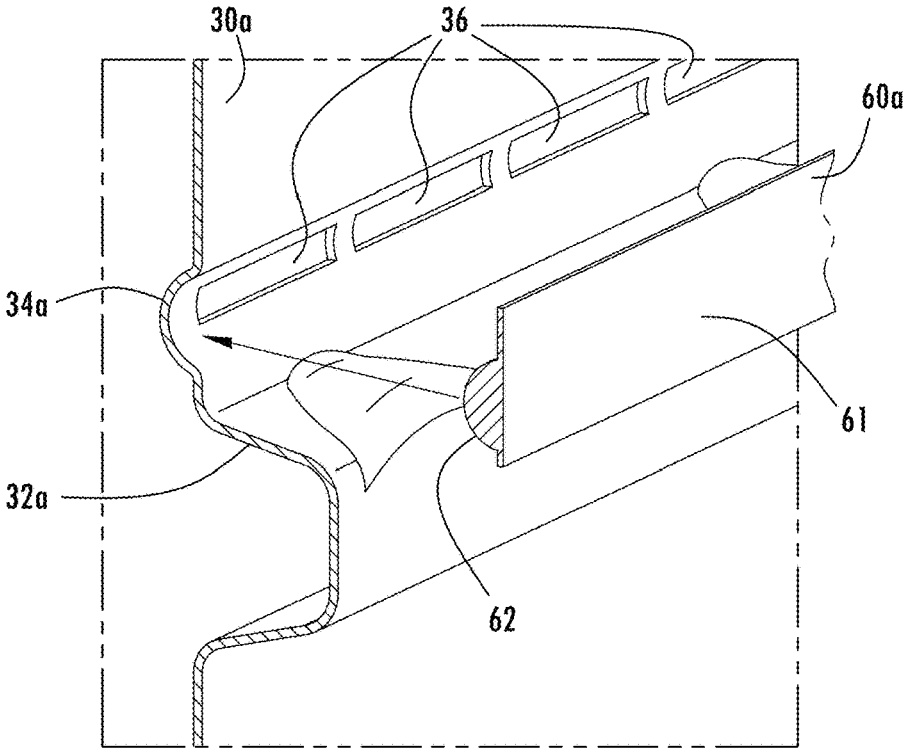
FIG. 7A is an even more enlarged perspective view of a side wall of the enclosed cavity of the oven shown in FIG.
Figure 8:
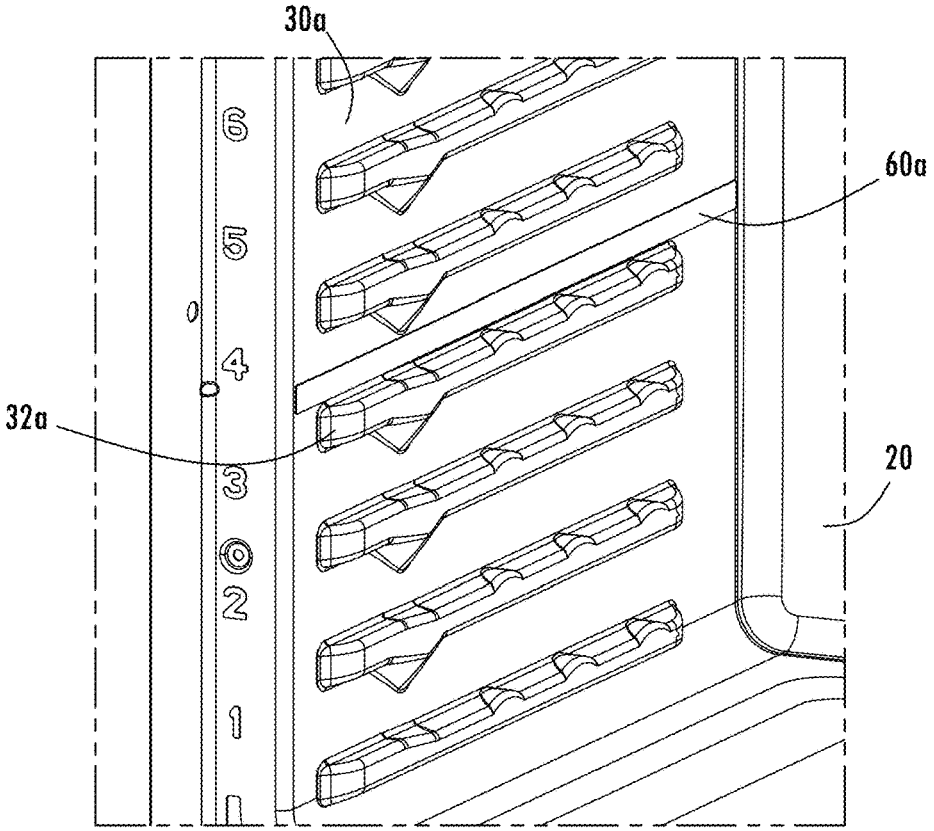
Figure 8A:
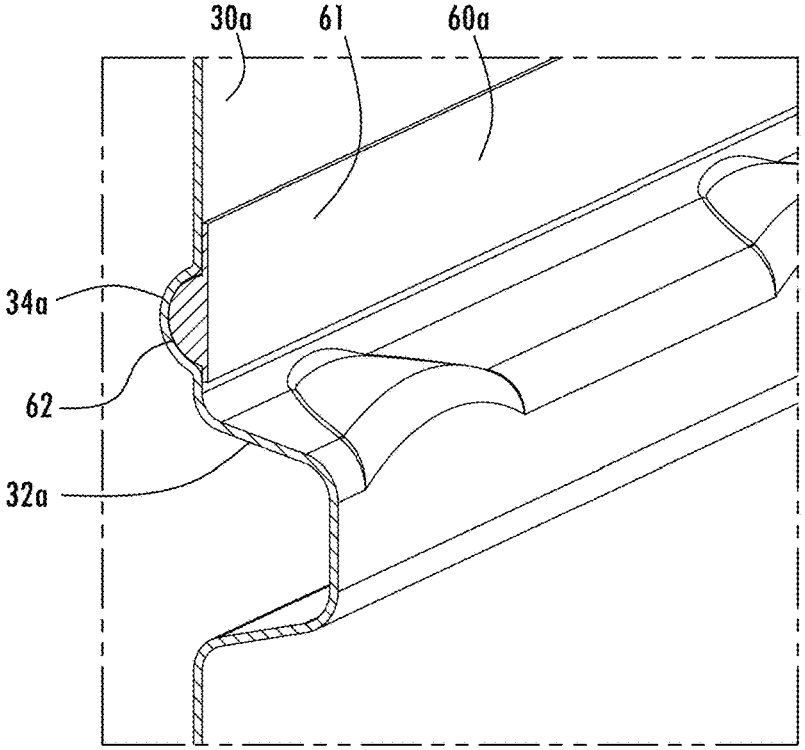
Figure 8B:
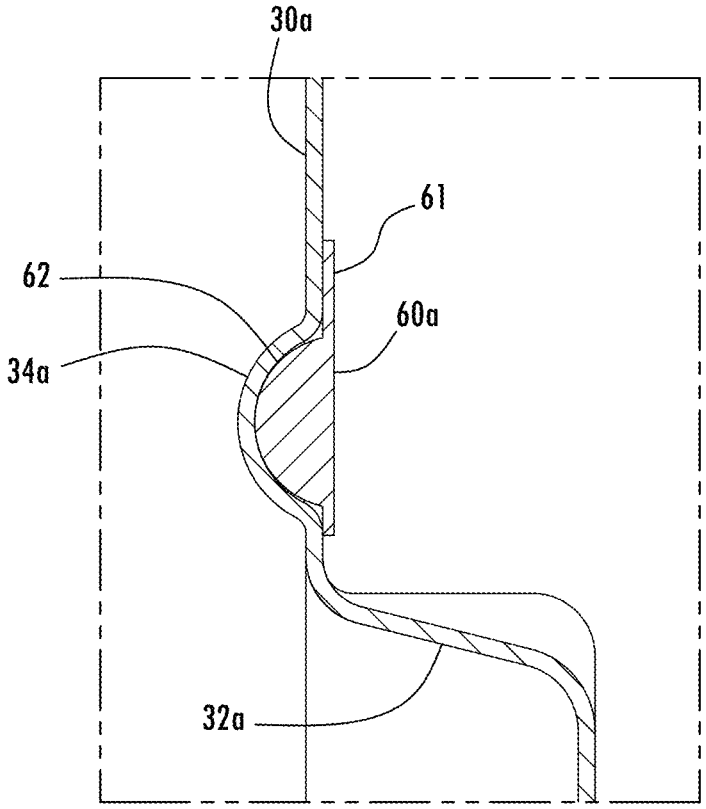
Figure 9:
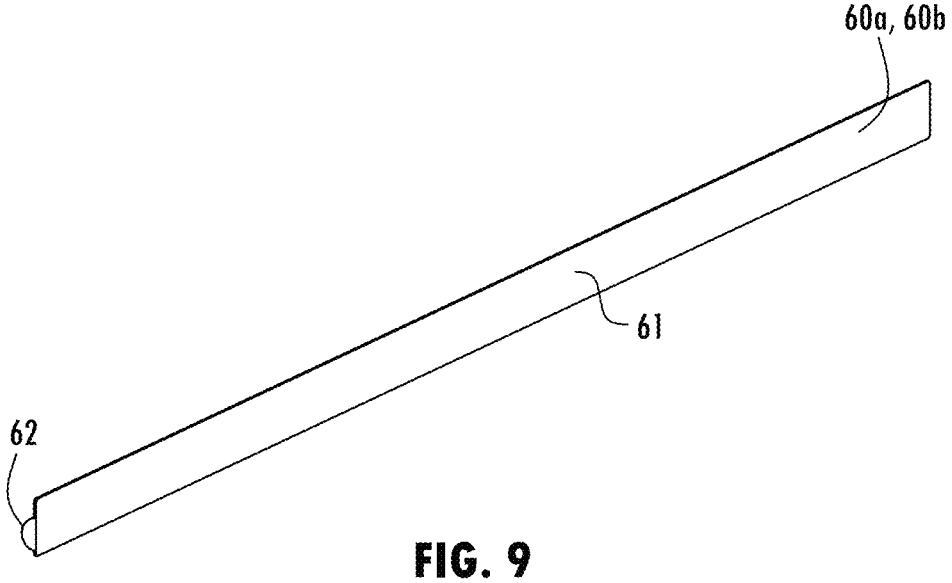
Figure 10:
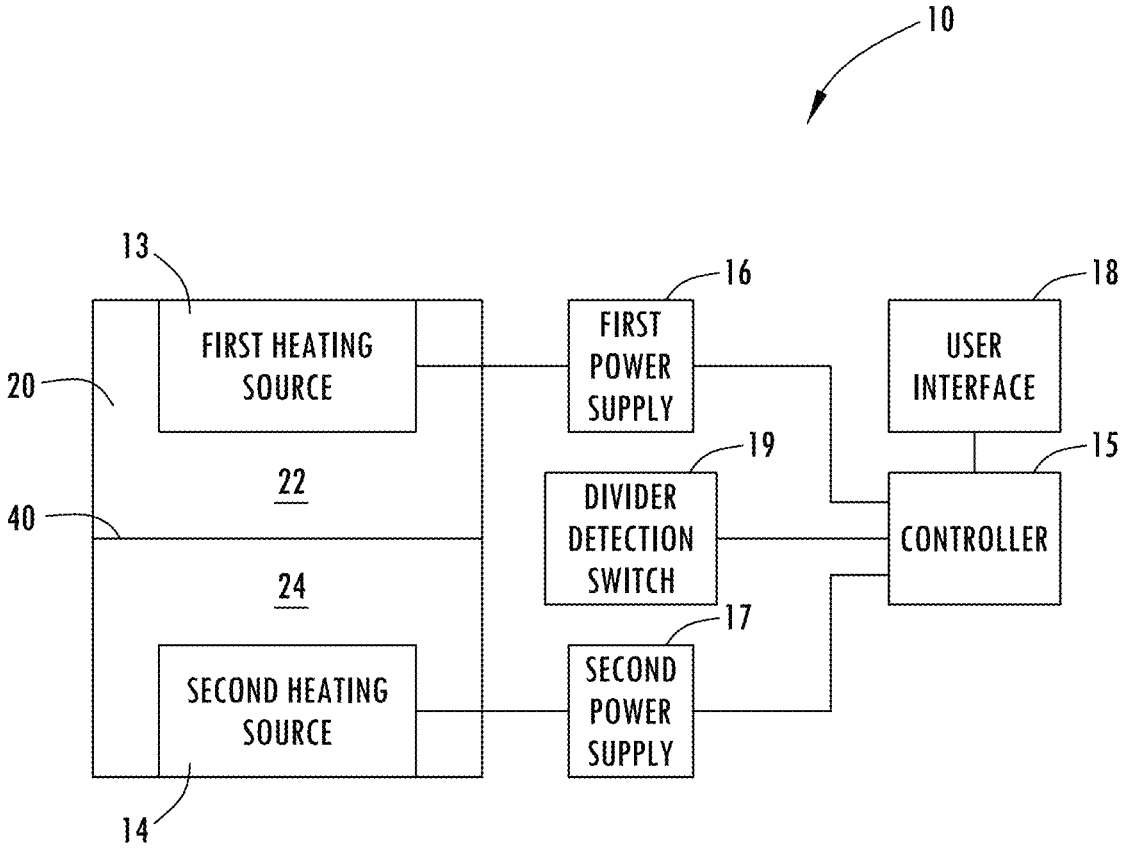
Figure 11:
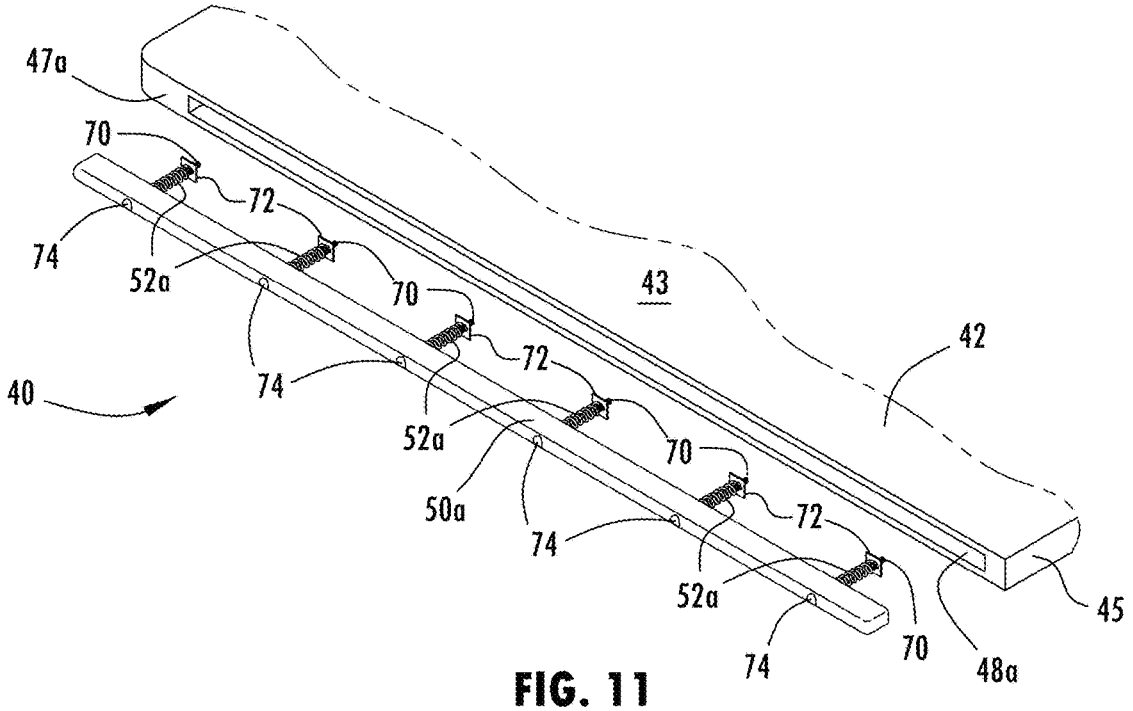
Figure 12:
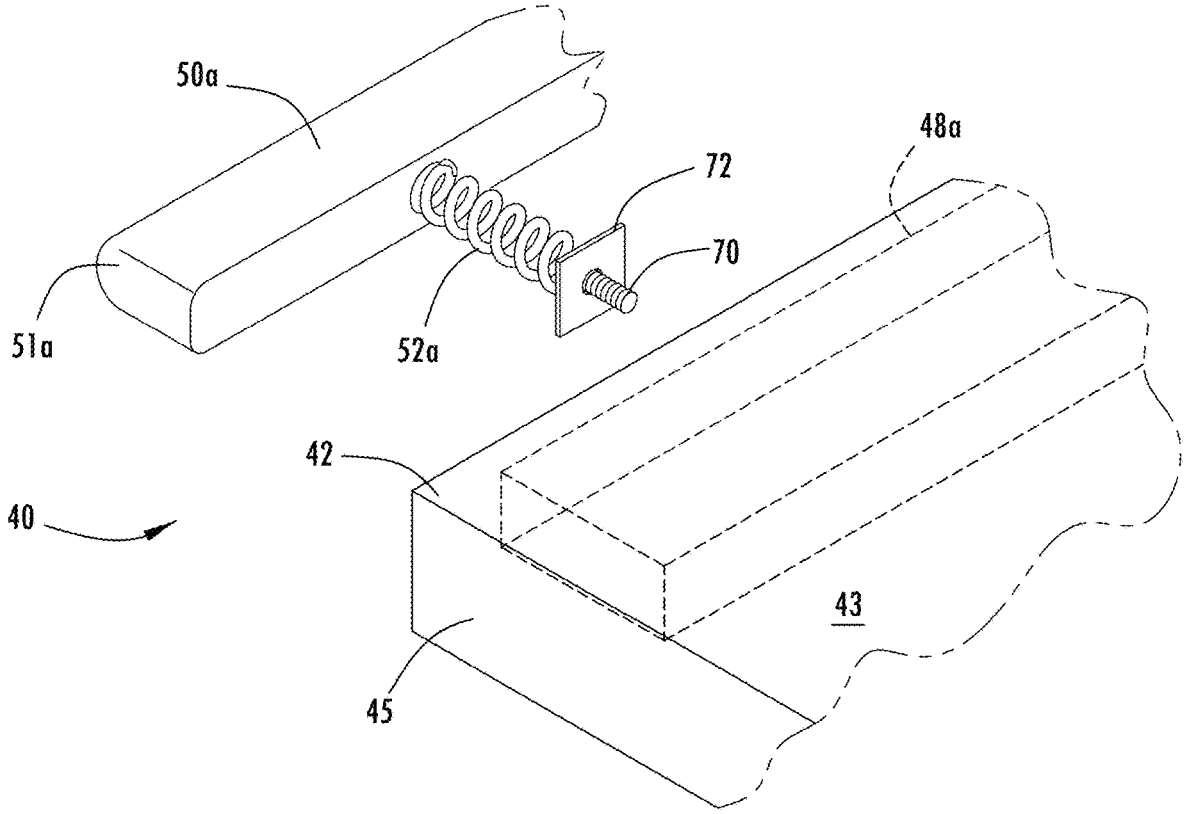
Figure 13:
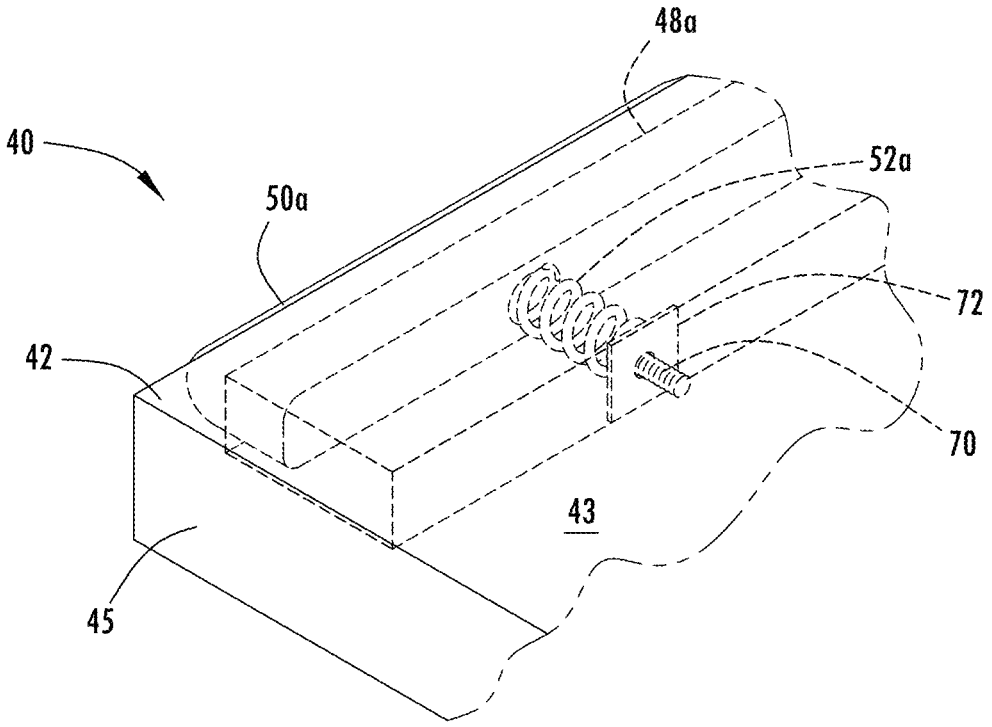
Figure 14:
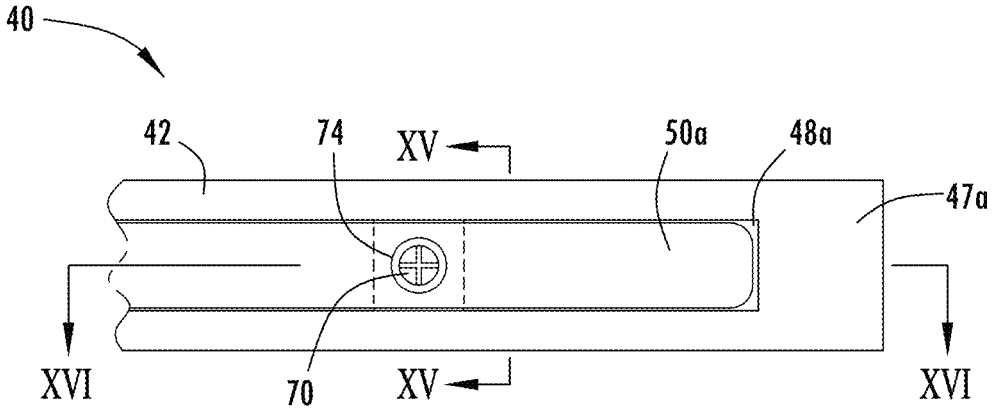
Figure 15:
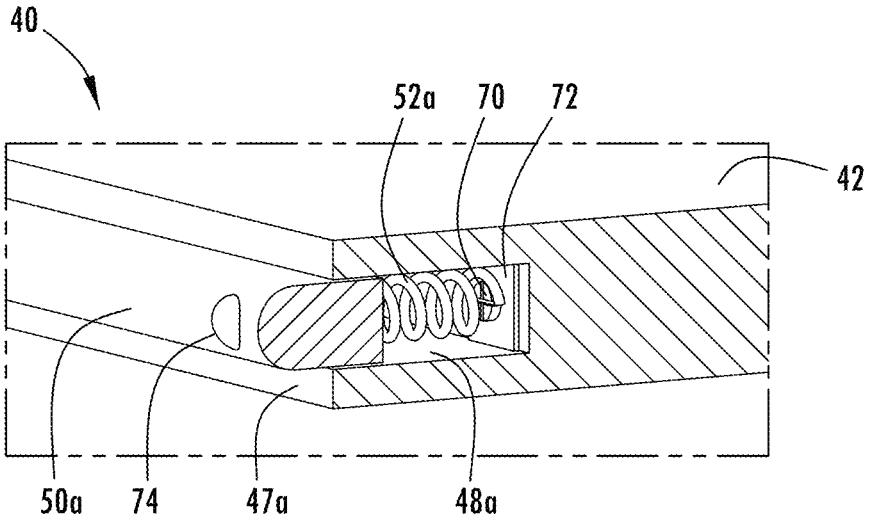
Figure 16:
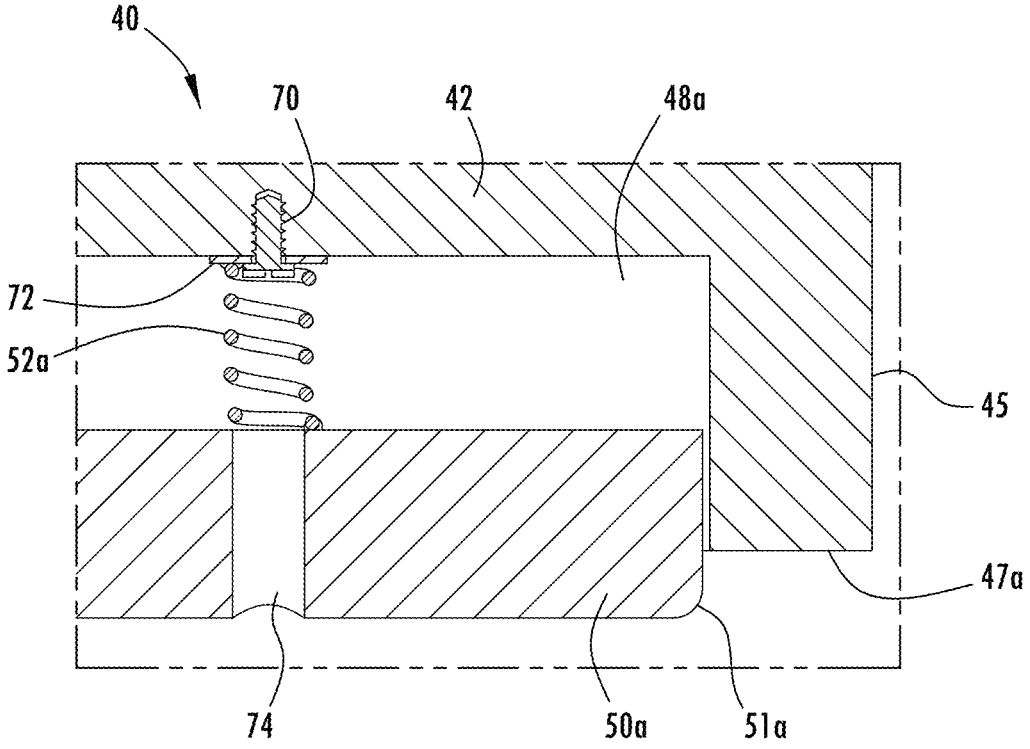

1 with a magnetic ribbon being inserted into a divider rail emboss when the divider assembly is removed;

FIG. 8 is an enlarged perspective view of a side wall of the enclosed cavity of the oven shown in FIG. 1 with a magnetic ribbon fully inserted into a divider rail emboss when the divider assembly is removed;

FIG. 8A is an even more enlarged perspective view of a side wall of the enclosed cavity of the oven shown in FIG. 1 with a magnetic ribbon fully inserted into a divider rail emboss when the divider assembly is removed;

FIG. 8B is an enlarged elevational view of a side wall of the enclosed cavity of the oven shown in FIG. 1 with a magnetic ribbon fully inserted into a divider rail emboss when the divider assembly is removed;

FIG. 9 is a perspective view of the magnetic ribbon shown in FIGS. 7-8B;

FIG. 10 is a block diagram of the electrical components of the oven shown in FIG. 1;

FIG. 11 is an exploded partial perspective view of the divider assembly shown in FIGS. 5 and 6A;

FIG. 12 is an another exploded partial perspective view of the divider assembly shown in FIGS. 5 and 6A;

FIG. 13 is a partial perspective view of the divider assembly shown in FIGS. 5 and 6A;

FIG. 14 is a partial elevational view of the divider assembly shown in FIGS. 5 and 6A;

FIG. 15 is a partial cross-sectional view of the divider assembly taken along line XV-XV in FIG. 14; and FIG. 16 is a partial cross-sectional view of the divider assembly taken along line XVI-XVI in FIG. 14.

The components in the figures are not necessarily to scale, emphasis instead being placed upon illustrating the principles described herein.

DETAILED DESCRIPTION

The present illustrated embodiments reside primarily in combinations of method steps and apparatus components related to a divider assembly for dividing an enclosed cooking cavity of an oven into two cooking subcavities. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Figure 2:
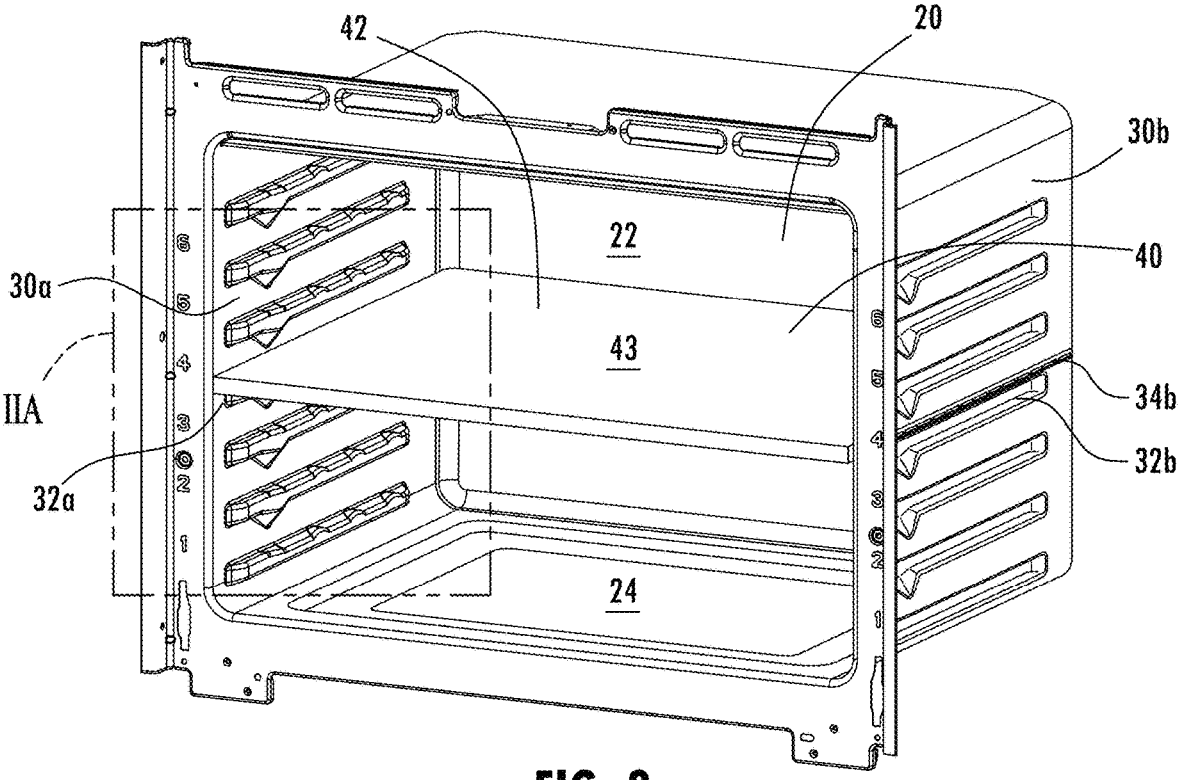
FIG. 2 is a perspective view of an enclosed cooking cavity of the oven shown in FIG. 1.
Figure 2A:
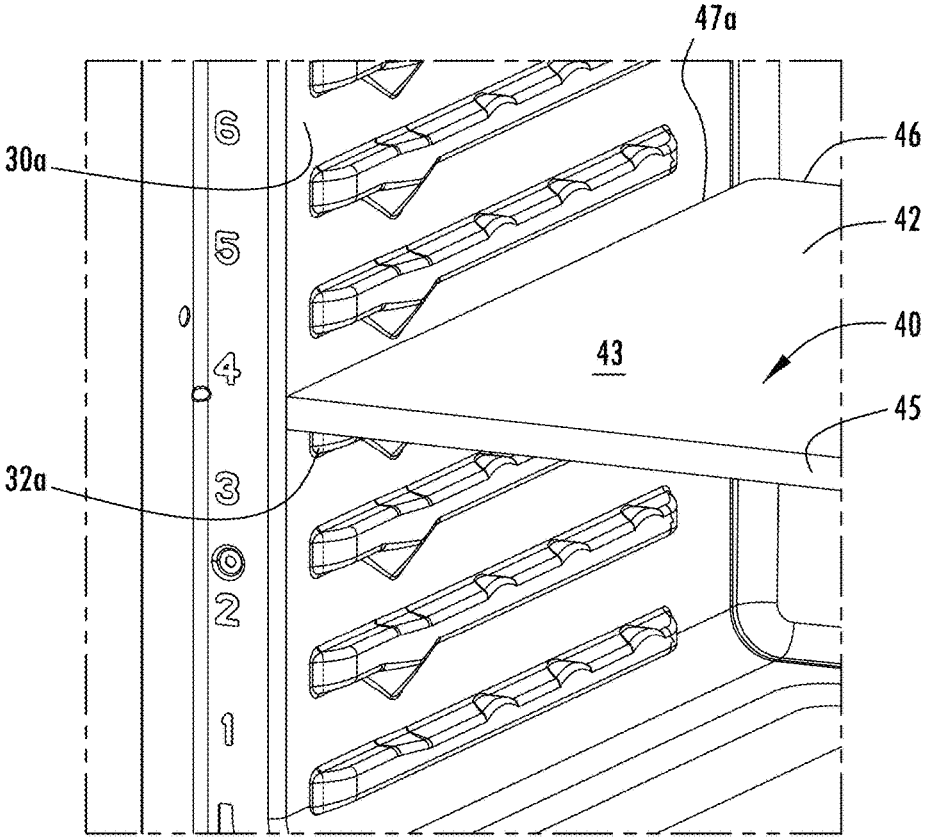
FIG. 2A is an enlarged perspective view of the enclosed cooking cavity shown in FIG. 2 of the region IIA.
Figure 3:
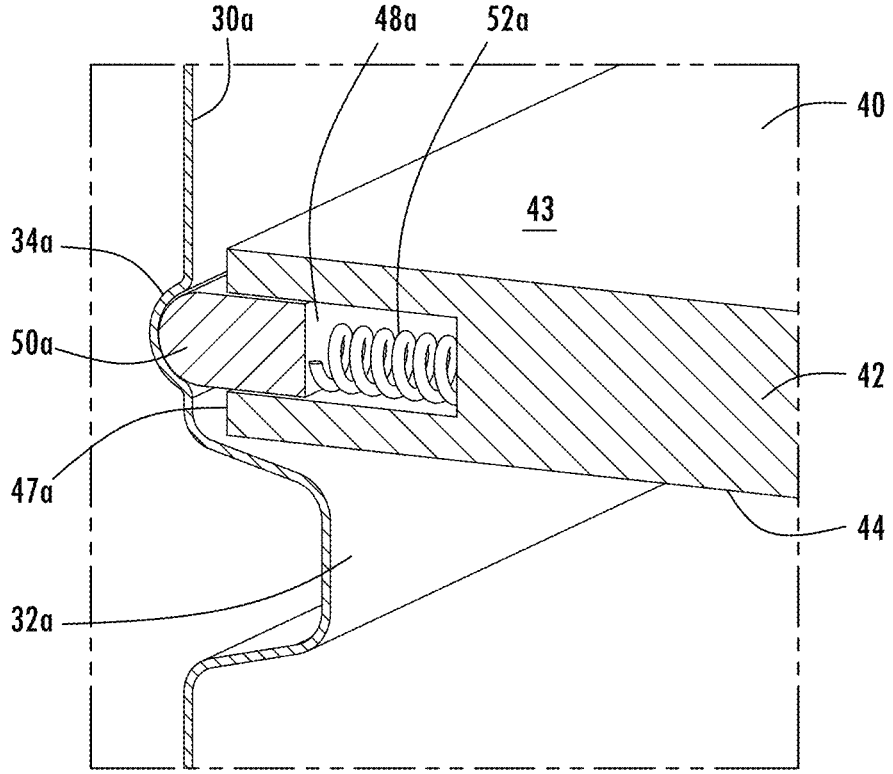
FIG. 3 is an enlarged perspective cross-sectional side view of a portion of the enclosed cooking cavity shown in FIG. 1 with a divider assembly fully installed.
Figure 3A:
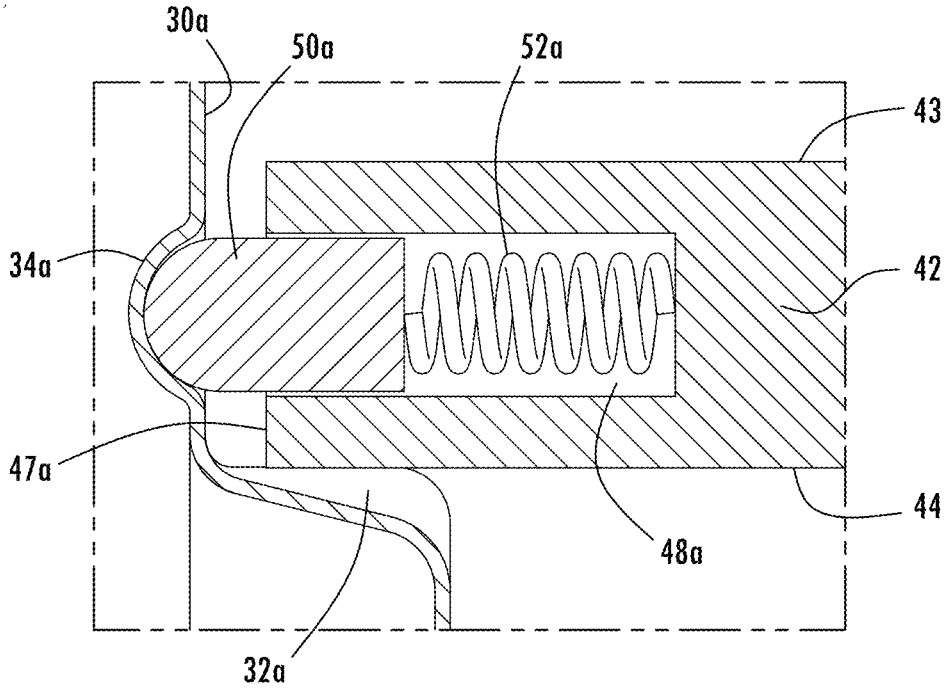
FIG. 3A is an enlarged elevational cross-sectional side view of a portion of the enclosed cooking cavity shown in FIG. 1 with a divider assembly fully installed.

Referring to FIGS. 1 and 10, reference numeral 10 generally designates an oven. As used herein, an "oven" may include any device with an enclosed heating chamber, and particularly may include a wall oven, a double wall oven, a range, or the like. As shown in FIGS. 1 and 2, the oven 10 may include an enclosed cooking cavity 20 behind a door 12 where the enclosed cooking cavity 20 has a first side wall 30*a* and a second side wall 30*b*. The first side wall 30*a* includes a first protruding divider rail 32*a* extending horizontally along the first side wall 30*a* and a first divider rail emboss 34*a* disposed above the first protruding divider rail 32*a*. The second side wall 30*b* includes a second protruding divider rail 32*b* extending horizontally along the second side wall 30*b* and a second divider rail emboss 34*b* disposed above the second protruding divider rail 32*b*. A divider assembly 40 is provided within the enclosed cooking cavity 20 so as to divide the enclosed cooking cavity 20 into a first cooking subcavity 22 and a second cooking subcavity 24. As best shown in FIG. 10, the oven 10 further includes a first heating source 13 for generating heat within the first cooking subcavity 22 to cook food disposed therein, and a second heating source 14 for generating heat within the second cooking subcavity 24 to cook food disposed therein. The first and second heating sources 13 and 14 are selectively powered by a first power supply 16 and a second power supply 17, respectively. The first and second power supplies 16 and 17 are controlled by a controller 15 in response to inputs from a user interface 18 and/or a divider detection switch 19, which detects the presence of the divider assembly 40.

As shown in FIGS. 6 and 6A, the divider assembly 40 includes a panel 42 having a top surface 43, a bottom surface 44, a front edge 45, a back edge 46, and a first side edge 47*a* and a second side edge 47*b*. The first side edge 47*a* includes a first recess 48*a* and the second side edge 47*b* includes a second recess 48*b*. The divider assembly 40 also includes: a first movable closure 50*a* positioned within the first recess 48*a*; a first plurality of springs 52*a* positioned within the first recess 48*a* for biasing the first movable closure 50*a* out from the first recess 48*a* while allowing the first movable closure 50*a* to slide inward inside the first recess 48*a*; a second movable closure 50*b* positioned within the second recess 48*b*; and a second plurality of springs 52*b* positioned within the second recess 48*b* for biasing the second movable closure 50*b* out from the second recess 48*b* while allowing the second movable closure 50*b* to slide inward inside the second recess 48*b*. The first and second movable closures 50*a*, 50*b* each have a peripheral surface with a curved cross-sectional profile that matches a curved cross-sectional profile of a corresponding one of the first and second divider rail embosses 34*a*, 34*b* with which the peripheral surface contacts to form an airtight seal. The panel 42 and the movable closures 50*a*, 50*b* may be made of an insulating material such as a fiberglass resin compound.

As shown in FIGS. 2A-5A, the first and second movable closures 50*a* and 50*b* are configured to extend into the respective first and second divider rail embosses 34*a* and

Figure 4:
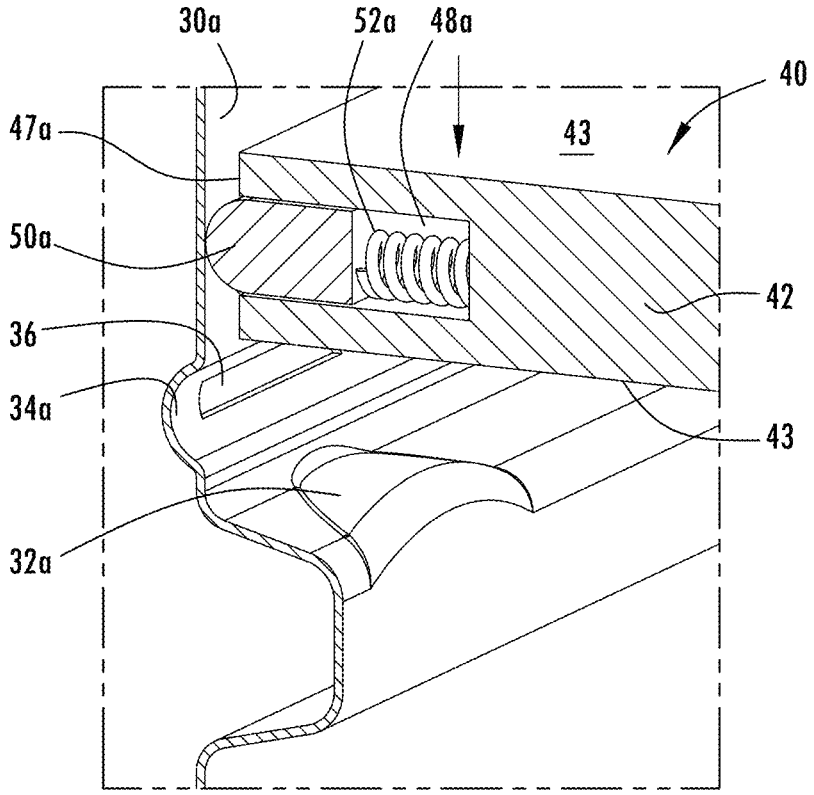
FIG. 4 is an enlarged perspective cross-sectional side view of a portion of the enclosed cooking cavity shown in FIG. 1 with a divider assembly being installed.
Figure 5A:
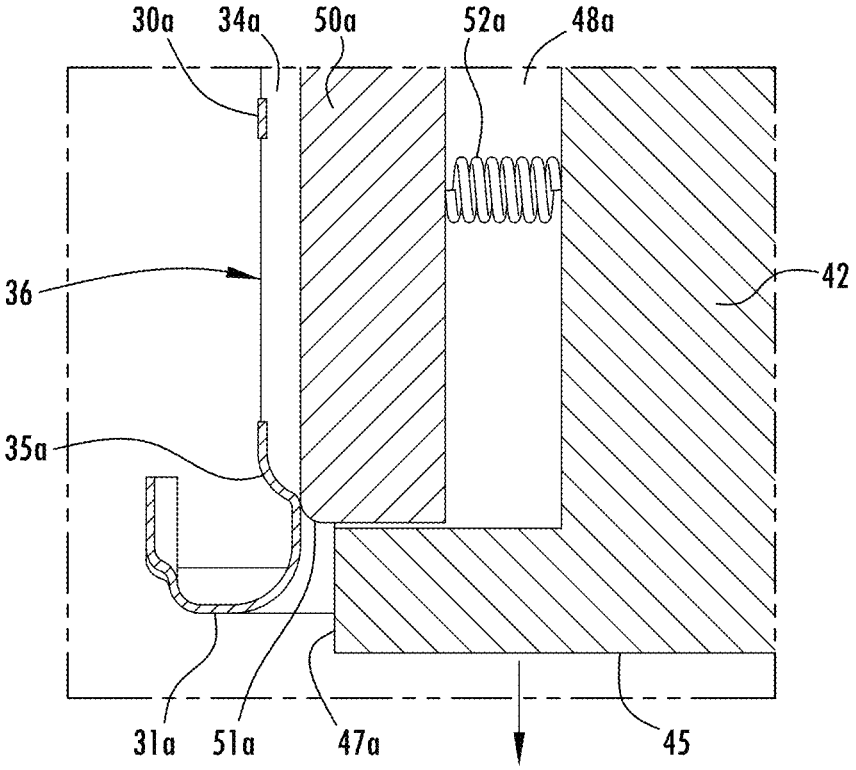
FIG. 5A is an enlarged isometric cross-sectional top view of a portion of the enclosed cooking cavity shown in FIG. 1 with a divider assembly being removed.

34*b* when the bottom surface 44 of the panel 42 rests on the first and second protruding divider rails 32*a* and 32*b* so as to lock the divider assembly 40 in place while increasing an airtightness and reducing heat migration between the subcavities 22 and 24. To reduce heat migration between the first and second cooking subcavities 22 and 24 through the first and second side walls 30*a* and 30*b*, the first and second divider rail embosses 34*a* and 34*b* each include a plurality of thermal break slots 36 as shown in FIGS. 4, 5A, and 7. The thermal break slots 36 each have a length greater than their height. The height of the thermal break slots 36 is less than the thickness of the first and second movable closures 50*a* and 50*b*.

Referring to FIGS. 7-9, the oven 10 may further include a first magnetic ribbon 60*a* to close the first divider rail emboss 34*a* when the divider assembly 40 is removed, and a second magnetic ribbon 60*b* to close the second divider rail emboss 34*b* when the divider assembly 40 is removed. The ribbons 60*a* and 60*b* may thus cover the thermal break slots 36 in the first and second divider rail embosses 34*a* and 34*b*. The ribbons 60*a* and 60*b* may include a flat inner-facing surface 61 and a curved outer-facing surface 62 that has a cross-sectional profile that matches that of the first and second divider rail embosses 34*a* and 34*b* such that an airtight seal is provided to keep heat from leaking through the thermal break slots 36.

As shown in FIGS. 5 and 5A, the front outer corner 51*a* of the first movable closure 50*a* has a tapered profile when viewed from above (or below) the divider panel 42. Similarly, the first divider rail emboss 34*a* has a front end 35*a* having a matching tapered profile when viewed from above the divider panel 42. The front outer corner 51*b* of the second movable closure 50*b* and the front end of the second divider rail emboss 34*b* may be similarly constructed. In this way, as shown in FIG. 5A, the divider panel 42 may be grasped and pulled forward from the enclosed heating cavity 20 and the first and second movable closures 50*a* and 50*b* slide inward within first and second recesses 48*a* and 48*b*, respectively, to allow the release from their locked positions (FIG. 5). When the divider panel 42 is fully inserted, the front edge 45 of the divider panel 42 is substantially flush with the front edge 31*a* of the first side wall 30*a* (and with the front edge of the second side wall 30*b*) to seal against the inside surface of door 12 and thereby inhibit heat transfer between the subcavities 22 and 24.

The manner in which the springs 52*a* may be attached to the first movable closure 50*a* and the panel 42 within the first recess 48*a* is now described with reference to FIGS. 11-16. It will be appreciated that the same manner may be used to secure springs 52*b* to the second movable closure 50*b* and the panel 42 within the second recess 48*b*. Each of the springs 52*a* may be molded into the first movable closure 50*a* or otherwise welded thereto. The springs 52*a* may then be attached by screws 70 and/or welds to the inside of first recess 48*a*. Washers 72 may be provided to hold the ends of the springs 52*a*. Apertures 74 may be provided in the first movable closure 50*a* that align with the center of each spring so as to allow insertion of a screw driver (not shown) to tighten the screws 70. It will be appreciated by those skilled in the art that any other mechanism may be used to attach the springs between the first movable closure 50*a* and the panel 42 within the first recess 48*a*.

According to one aspect of the present disclosure, an oven is provided including: an enclosed cooking cavity having first and second side walls, the first side wall comprising a first protruding divider rail extending horizontally along the first side wall and a first divider rail emboss disposed above the first protruding divider rail, the second side wall comprising a second protruding divider rail extending horizontally along the second side wall and a second divider rail emboss disposed above the second protruding divider rail; a divider assembly within the enclosed cooking cavity so as to divide the enclosed cooking cavity into a first cooking subcavity and a second cooking subcavity; a first heating source for generating heat within the first cooking subcavity to cook food disposed therein; and a second heating source for generating heat within the second cooking subcavity to cook food disposed therein. The divider assembly includes: a panel having a top surface, a bottom surface, and first and second side edges, the first side edge comprising a first recess and the second side edge comprising a second recess; a first movable closure positioned within the first recess; a first plurality of springs positioned within the first recess for biasing the first movable closure out from the first recess while allowing the first movable closure to slide inward inside the first recess; a second movable closure positioned within the second recess; and a second plurality of springs positioned within the second recess for biasing the second movable closure out from the second recess while allowing the second movable closure to slide inward inside the second recess. The first and second movable closures are configured to extend into the respective first and second divider rail embosses when the bottom surface of the panel rests on the first and second protruding divider rails so as to lock the divider assembly in place while increasing an airtightness and reducing heat migration.

In the above-described oven, the first and second divider rail embosses may each include a plurality of thermal break slots to reduce heat migration between the first and second cooking subcavities through the first and second side walls.

In the above-described oven, the thermal break slots may each have a length greater than their height, and wherein the height of the thermal break slots is less than the thickness of the first and second movable closures.

The oven may further include a first magnetic ribbon to close the first divider rail emboss when the divider assembly is removed; and a second magnetic ribbon to close the second divider rail emboss when the divider assembly is removed.

In the above-described oven, the first and second movable closures may each have a peripheral surface with a curved cross-sectional profile that matches a curved cross-sectional profile of a corresponding one of the first and second divider rail embosses with which the peripheral surface contacts to form an airtight seal.

In the above-described oven, the panel may be made of an insulating material.

In the above-described oven, the panel may be made of a fiberglass resin compound.

In the above-described oven, the first and second movable closures may be made of a fiberglass resin compound.

In the above-described oven, front outer corners of the first and second moveable closures may have a tapered profile when viewed from above the divider panel and front ends of the first and second divider rail embosses have a matching tapered profile that allows the divider assembly to be slid forward to be released from locked positions and removed from the oven.

According to another aspect of the present disclosure, a divider assembly is provided for dividing an enclosed cooking cavity of an oven into two cooking subcavities, the oven including a first side wall and a second side wall within the enclosed cooking cavity, the first and second side walls including respective first and second divider rail embosses extending horizontally. The divider assembly including: a panel having a top surface, a bottom surface, and first and second side edges, the first side edge comprising a first recess and the second side edge comprising a second recess; a first movable closure positioned within the first recess; a first plurality of springs positioned within the first recess for biasing the first movable closure out from the first recess while allowing the first movable closure to slide inward inside the first recess; a second movable closure positioned within the second recess; and a second plurality of springs positioned within the second recess for biasing the second movable closure out from the second recess while allowing the second movable closure to slide inward inside the second recess. The first and second movable closures are configured to extend into the respective first and second divider rail embosses so as to lock the divider assembly in place while increasing an airtightness and reducing heat migration.

The divider assembly of claim 10, wherein the panel is made of an insulating material.

In the above-described divider assembly, the panel may be made of a fiberglass resin compound.

In the above-described divider assembly, the first and second movable closures may be made of a fiberglass resin compound.

In the above-described divider assembly, the first and second movable closures may each have a peripheral surface with a curved cross-sectional profile that matches a curved cross-sectional profile of a corresponding one of the first and second divider rail embosses with which the peripheral surface contacts to form an airtight seal.

According to yet another aspect of the present disclosure, a method is provided for dividing an enclosed cooking cavity of an oven into a first cooking subcavity and a second cooking subcavity, where the oven includes first and second side walls each having a respective first and second divider rail emboss extending horizontally. The method comprises: providing a divider assembly within the enclosed cooking cavity so as to divide the enclosed cavity into the first cooking subcavity and the second cooking subcavity, wherein the divider assembly includes: a panel having a top surface, a bottom surface, and first and second side edges, the first side edge comprising a first recess and the second side edge comprising a second recess; a first movable closure positioned within the first recess; a first plurality of springs positioned within the first recess for biasing the first movable closure out from the first recess while allowing the first movable closure to slide inward inside the first recess; a second movable closure positioned within the second recess; and a second plurality of springs positioned within the second recess for biasing the second movable closure out from the second recess while allowing the second movable closure to slide inward inside the second recess. The first and second movable closures are configured to extend into the respective first and second divider rail embosses so as to lock the divider assembly in place while increasing an airtightness and reducing heat migration.

In the above-described method, the first side wall may further include a first protruding divider rail extending horizontally along the first side wall below the first divider rail emboss, and the second side wall includes a second protruding divider rail extending horizontally along the second side wall below the second divider rail emboss, wherein the first and second movable closures are configured to extend into the respective first and second divider rail embosses when the bottom surface of the panel rests on the first and second protruding divider rails.

In the above-described method, the panel may be made of an insulating material.

In the above-described method, the panel may be made of a fiberglass resin compound.

In the above-described method, the first and second movable closures may be made of a fiberglass resin compound.

In the above-described method, the first and second movable closures may each have a peripheral surface with a curved cross-sectional profile that matches a curved cross-sectional profile of a corresponding one of the first and second divider rail embosses with which the peripheral surface contacts to form an airtight seal.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An oven comprising:

an enclosed cooking cavity having first and second side walls, the first side wall comprising a first protruding divider rail extending horizontally along the first side wall and a first divider rail emboss disposed above the first protruding divider rail, the second side wall comprising a second protruding divider rail extending horizontally along the second side wall and a second divider rail emboss disposed above the second protruding divider rail;

a divider assembly within the enclosed cooking cavity so as to divide the enclosed cooking cavity into a first cooking subcavity and a second cooking subcavity;

a first heating source for generating heat within the first cooking subcavity to cook food disposed therein; and a second heating source for generating heat within the second cooking subcavity to cook food disposed therein, wherein the divider assembly comprises:

a panel having a top surface, a bottom surface, and first and second side edges, the first side edge comprising a first recess and the second side edge comprising a second recess;

a first movable closure positioned within the first recess;

a first plurality of springs positioned within the first recess for biasing the first movable closure out from the first recess while allowing the first movable closure to slide inward inside the first recess;

a second movable closure positioned within the second recess; and a second plurality of springs positioned within the second recess for biasing the second movable closure out from the second recess while allowing the second movable closure to slide inward inside the second recess, wherein the first and second movable closures are configured to extend into the respective first and second divider rail embosses when the bottom surface of the panel rests on the first and second protruding divider rails so as to lock the divider assembly in place while increasing an airtightness and reducing heat migration.

2. The oven of claim 1, wherein the first and second divider rail embosses each include a plurality of thermal break slots to reduce heat migration between the first and second cooking subcavities through the first and second side walls.

3. The oven of claim 2, wherein the thermal break slots each have a length greater than their height, and wherein the height of the thermal break slots is less than the thickness of the first and second movable closures.

4. The oven of claim 1 and further comprising a first magnetic ribbon to close the first divider rail emboss when the divider assembly is removed; and a second magnetic ribbon to close the second divider rail emboss when the divider assembly is removed.

5. The oven of claim 1, wherein the first and second movable closures each have a peripheral surface with a curved cross-sectional profile that matches a curved cross-sectional profile of a corresponding one of the first and second divider rail embosses with which the peripheral surface contacts to form an airtight seal.

6. The oven of claim 1, wherein the panel is made of an insulating material.

7. The oven of claim 1, wherein the panel is made of a fiberglass resin compound.

8. The oven of claim 1, wherein the first and second movable closures are made of a fiberglass resin compound.

9. The oven of claim 1, wherein front outer corners of the first and second moveable closures have a tapered profile when viewed from above the divider panel and front ends of the first and second divider rail embosses have a matching tapered profile that allows the divider assembly to be slid forward to be released from locked positions and removed from the oven.

10. A divider assembly for dividing an enclosed cooking cavity of an oven into two cooking subcavities, the oven including a first side wall and a second side wall within the enclosed cooking cavity, the first and second side walls including respective first and second divider rail embosses extending horizontally, the divider assembly comprising:

a panel having a top surface, a bottom surface, and first and second side edges, the first side edge comprising a first recess and the second side edge comprising a second recess;

a first movable closure positioned within the first recess;

a first plurality of springs positioned within the first recess for biasing the first movable closure out from the first recess while allowing the first movable closure to slide inward inside the first recess;

a second movable closure positioned within the second recess; and a second plurality of springs positioned within the second recess for biasing the second movable closure out from the second recess while allowing the second movable closure to slide inward inside the second recess, wherein the first and second movable closures are configured to extend into the respective first and second divider rail embosses so as to lock the divider assembly in place while increasing an airtightness and reducing heat migration.

11. The divider assembly of claim 10, wherein the panel is made of an insulating material.

12. The divider assembly of claim 10, wherein the panel is made of a fiberglass resin compound.

13. The divider assembly of claim 10, wherein the first and second movable closures are made of a fiberglass resin compound.

14. The divider assembly of claim 10, wherein the first and second movable closures each have a peripheral surface with a curved cross-sectional profile that matches a curved cross-sectional profile of a corresponding one of the first and second divider rail embosses with which the peripheral surface contacts to form an airtight seal.

15. A method of dividing an enclosed cooking cavity of an oven into a first cooking subcavity and a second cooking subcavity, where the oven includes first and second side walls each having a respective first and second divider rail emboss extending horizontally, the method comprises:

providing a divider assembly within the enclosed cooking cavity so as to divide the enclosed cavity into the first cooking subcavity and the second cooking subcavity, wherein the divider assembly comprises:

a panel having a top surface, a bottom surface, and first and second side edges, the first side edge comprising a first recess and the second side edge comprising a second recess;

a first movable closure positioned within the first recess;

a first plurality of springs positioned within the first recess for biasing the first movable closure out from the first recess while allowing the first movable closure to slide inward inside the first recess;

a second movable closure positioned within the second recess; and a second plurality of springs positioned within the second recess for biasing the second movable closure out from the second recess while allowing the second movable closure to slide inward inside the second recess, wherein the first and second movable closures are configured to extend into the respective first and second divider rail embosses so as to lock the divider assembly in place while increasing an airtightness and reducing heat migration.

16. The method of claim 15, wherein the first side wall further includes a first protruding divider rail extending horizontally along the first side wall below the first divider rail emboss, and the second side wall includes a second protruding divider rail extending horizontally along the second side wall below the second divider rail emboss, wherein the first and second movable closures are configured to extend into the respective first and second divider rail embosses when the bottom surface of the panel rests on the first and second protruding divider rails.

17. The method of claim 15, wherein the panel is made of an insulating material.

18. The method of claim 15, wherein the panel is made of a fiberglass resin compound.

19. The method of claim 15, wherein the first and second movable closures are made of a fiberglass resin compound.

20. The method of claim 15, wherein the first and second movable closures each have a peripheral surface with a curved cross-sectional profile that matches a curved cross-sectional profile of a corresponding one of the first and second divider rail embosses with which the peripheral surface contacts to form an airtight seal.

* * * * *